US008695252B2

(12) United States Patent
Urbina

(10) Patent No.: US 8,695,252 B2
(45) Date of Patent: Apr. 15, 2014

(54) SYSTEM FOR ADVERTISEMENT

(71) Applicant: Herenia Urbina, Miami, FL (US)

(72) Inventor: Herenia Urbina, Miami, FL (US)

( * ) Notice: Subject to any disclaimer, the term of this patent is extended or adjusted under 35 U.S.C. 154(b) by 33 days.

(21) Appl. No.: 13/622,217

(22) Filed: Sep. 18, 2012

(65) Prior Publication Data

US 2014/0075797 A1 Mar. 20, 2014

(51) Int. Cl.
*G09F 15/02* (2006.01)

(52) U.S. Cl.
USPC ..... 40/607.01; 40/603; 40/661; 40/607.12; 116/173

(58) Field of Classification Search
USPC ..... 116/173; 248/125.2, 507; 40/607.04, 40/607.09, 661.11
See application file for complete search history.

(56) References Cited

U.S. PATENT DOCUMENTS

| | | | | | |
|---|---|---|---|---|---|
| 3,011,810 | A | * | 12/1961 | Crowder | 403/328 |
| 3,225,734 | A | * | 12/1965 | Bule | 116/173 |
| 3,732,845 | A | * | 5/1973 | Istre | 116/173 |
| 3,870,301 | A | * | 3/1975 | Brisendine | 473/179 |
| 4,095,360 | A | | 6/1978 | Dinan et al. | |
| 4,248,000 | A | | 2/1981 | Greenbaum | |
| 4,309,784 | A | * | 1/1982 | Cohen | 5/639 |
| 4,407,505 | A | * | 10/1983 | Kendziorski | 473/173 |
| 4,656,767 | A | * | 4/1987 | Tarrant | 40/316 |
| 5,058,299 | A | | 10/1991 | Suzuki | |
| 5,103,582 | A | * | 4/1992 | Farmer | 40/607.12 |
| 5,303,931 | A | * | 4/1994 | Brown | 273/348 |
| 5,610,770 | A | * | 3/1997 | Galiani | 359/807 |
| 5,815,965 | A | | 10/1998 | Greeve | |
| 6,338,212 | B1 | | 1/2002 | Santa Cruz et al. | |
| 6,578,305 | B2 | | 6/2003 | Lebrun | |
| 7,093,857 | B2 | * | 8/2006 | Martin | 283/2 |
| 7,270,237 | B2 | * | 9/2007 | Mandeltort | 206/455 |
| 7,520,075 | B1 | | 4/2009 | Clark | |
| 7,921,582 | B2 | * | 4/2011 | Nathanson et al. | 40/124.06 |
| 8,181,376 | B2 | | 5/2012 | Rietveld | |
| 2001/0054245 | A1 | * | 12/2001 | Williams | 40/661 |
| 2004/0111944 | A1 | | 6/2004 | Gatt et al. | |
| 2006/0086308 | A1 | * | 4/2006 | Chen | 116/174 |
| 2007/0107287 | A1 | | 5/2007 | Huang | |
| 2008/0222934 | A1 | * | 9/2008 | Dworetz | 40/661 |
| 2009/0265972 | A1 | | 10/2009 | Chang et al. | |
| 2010/0031546 | A1 | * | 2/2010 | Nwatu | 40/607.1 |
| 2010/0050485 | A1 | | 3/2010 | Forte et al. | |
| 2012/0073170 | A1 | | 3/2012 | Boltz et al. | |

* cited by examiner

*Primary Examiner* — Shin Kim
(74) *Attorney, Agent, or Firm* — Albert Bordas, P.A.

(57) ABSTRACT

A system for advertising, having a post assembly with first and second ends. The first end has a first neck member with a first threaded opening having a cap thereon, and the second end having a second neck member with a second threaded opening. A display assembly has first and second transparent or translucent walls joined at least at first, second, and third edges. The display assembly further has a first seam to define a first channel and a second seam to define a second channel. A fourth edge defines a sealing edge. First and second elongated rods prevent the display assembly from bending or flapping. The display assembly displays matter housed between the first and second transparent or translucent walls. An extension post assembly has third and fourth ends, and at least one tension arm.

20 Claims, 3 Drawing Sheets

SYSTEM FOR ADVERTISEMENT

BACKGROUND OF THE INVENTION

1. Field of the Invention

The present invention relates to advertising systems, and more particularly, to systems for advertisement having multiple mounting configurations.

2. Description of the Related Art

Applicant believes that one of the closest references corresponds to U.S. Patent Application Publication No. 20120073170 A1, published on Mar. 29, 2012 to Boltz, et al. for a fence wrapping assembly and a method of utilizing the same. However, it differs from the present invention because Boltz, et al. teaches a fence wrapping assembly for retaining a panel of sheet material adjacent one or both of a front and back of a fence. The panel has one or more pockets formed therein; a carrier is received in each pocket and a mounting member engages each carrier and secures the same to one of a first and second fence post. A tensioning device extends between the first and second fence posts and engages the panel. The device is adjustable to apply tension to the panel. Advertising graphics are applied to the panel's exterior surface.

Applicant believes that another reference corresponds to U.S. Patent Application Publication No. 20100050485 A1, published on Mar. 4, 2010 to Forte, et al. for a tethered display frame. However, it differs from the present invention because Forte, et al. teaches a tethered display frame having a planar backer sheet, a top sheet of transparent or translucent material overlaying the planar backer sheet, a border attached along a common periphery of the planar backer sheet and the top sheet, a plurality of straps fastened to the frame, and a fastener affixed to distal ends of each of the straps whereby the frame can be releasably fastened to an article. The border encloses the planar backer sheet and the top sheet on three sides with a fourth side providing means for a user to insert a display item between the top sheet and the planar backer sheet.

Applicant believes that another reference corresponds to U.S. Patent Application Publication No. 20090265972 A1, published on Oct. 29, 2009 to Chang, et al. for sheet holders. However, it differs from the present invention because Chang, et al. teaches a sheet holder either with or without a board. The sheet holder comprises a base angle plate and a holding angle plate, connected by extension springs for toggling said holding angle plate between a closed position for holding said sheet and an open position for removing said sheet. Two pegs and a rubber block with groove are installed for increasing the number of held sheets and more securely holding the mounted sheets. The sheet holding board can be rotatably mounted to the back of a picture frame with locking feature. The sheet holder without board can be applied for holding advertisement sheet for indoor and outdoor display. Novel art hanging and control system will raise and lock the art for display, and lower it to a reachable level for display change. This art may include an art sheet, 3D art, or a computer monitor showing advertisement message. For outdoor display, a clear vinyl cover can be employed for holding an art sheet and protect it from UV radiation, rain and wind damage. A spring or weight load can be employed to maintain the art to be displayed in its uppermost position and leveled. Such spring and weight load can also be used in a flagpole for such benefit.

Applicant believes that another reference corresponds to U.S. Patent Application Publication No. 20070107287 A1, published on May 17, 2007 to Huang for an information display folder. However, it differs from the present invention because Huang teaches an information display folder enclosing and retaining documents.

Applicant believes that another reference corresponds to U.S. Patent Application Publication No. 20040111944 A1, published on Jun. 17, 2004 to Gatt, et al. for a quick-change picture frame. However, it differs from the present invention because Gatt, et al. teaches picture frames that can be quickly and safely assembled, installed, and disassembled to display artwork. The picture frame has a frame member and backing that are adapted for safe, easy and removable assembly using removable attachment means, and are designed for safe use by children, elderly, and disabled adults without the need for adult assistance or supervision.

Applicant believes that another reference corresponds to U.S. Pat. No. 8,181,376 B2 issued to Rietveld on May 22, 2012 for a floor display. However, it differs from the present invention because Rietveld teaches a floor display that comprises a window plate made from a transparent material, a baseplate, and a frame made from flexible material, the frame extending around the two plates and holding them together, it being possible for an exchangeable image carrier made of material in sheet or film form to be placed between the plates, the frame being non-releasably connected, by means of a bonded join, to substantially the entire peripheral edge of the window plate, and the frame furthermore being non-releasably connected, by means of a bonded join, to at most two peripheral edge sides of the baseplate.

Applicant believes that another reference corresponds to U.S. Pat. No. 7,520,075 B1 issued to Clark on Apr. 21, 2009 for a sign and method of making the same. However, it differs from the present invention because Clark teaches a sign having at least one support that is removably inserted into a core and the ground. A clamp is secured to the upper edge of the core, in part, by a connector system. The connector system also removably secures the support to the core. Sheets containing pigment-containing material may be secured to the core via the clamp. A removable cover, having pigment-containing material, may be located over the core.

Applicant believes that another reference corresponds to U.S. Pat. No. 6,578,305 B2 issued to Lebrun on Jun. 17, 2003 for a framing system with three-dimensional shims for displaying three-dimensional objects. However, it differs from the present invention because Lebrun teaches an adjustable framing system for three-dimensional objects, which has a three-dimensional shimming system and an access door in the rear. The access door allows objects to be inserted, and then temporarily removed for examination, and subsequently easily replaced. The framing system has a deep compartment for holding publications having a variety of sizes. The framing system is designed to accommodate varying sized publications by using matting in the front of the event programs, and a three-dimensional shimming system, which includes vertical and horizontal shimming on the sides of the event program, and thickness shimming on the rear of the event program. An internal wall provides depth for an internal cavity, which provides room for publications or other objects that vary in thickness. Separate display compartments may be provided for displaying tickets or descriptive labels for the objects in the frame.

Applicant believes that another reference corresponds to U.S. Pat. No. 6,338,212 B1 issued to Santa Cruz, et al. on Jan. 15, 2002 for an advertisement display apparatus. However, it differs from the present invention because Santa Cruz, et al. teaches an advertisement display apparatus, which is completely portable, self-contained, requires no installation tools, and is most efficient for display of signs.

Applicant believes that another reference corresponds to U.S. Pat. No. 5,815,965 B1 issued to de Greeve on Oct. 6, 1998 for a portable dealer license plate and advertising strip holder. However, it differs from the present invention because de Greeve teaches a portable license plate holder for supporting an advertising strip and a license plate in a vertical relationship, including a back side portion having a width sufficiently wider than the license plate to permit fastening thereto adjacent to both opposite lateral sides of the license plate, and a height sufficiently higher than the combined height of the advertising strip and the license plate to permit fastening thereto both above, below, and horizontally between the advertising strip and license plate; a front side portion mated to cover the back side portion and fastened thereto along a top, bottom, and side portion thereof, as well as horizontally along a central portion thereof whereby two horizontal pockets are formed for the lateral insertion of the license plate and the advertising strip; a strip having opposite ends, each end carrying an opposite lateral side portion of the back side portion; and, a fastener to releasably close the back side portion to the front side portion along the unfastened side portions thereof. The license is encased between the front and back side portions, which are preferably made of vinyl. The license plate holder is made of material that will not damage the finish on the vehicles.

Applicant believes that another reference corresponds to U.S. Pat. No. 5,058,299 B1 issued to Suzuki on Oct. 22, 1991 for an advertising device. However, it differs from the present invention because Suzuki teaches an advertising device for detachably attaching a flexible sheet-like advertising bill. The device comprises a flexible sheet member on which the advertising bill is disposed. An expansible member is disposed in an intermediate portion of the sheet member. The advertising bill is detachably fastened to the sheet member by a fastener comprising a pair of fastening elements, namely a first element and a second element. The first element is secured to the sheet member. The second element is secured to the advertising bill. The first and the second elements cooperate with each other to fasten the advertising bill to the sheet member. The peripheral edge of the sheet member is connected to an advertising place. And an adjuster is provided for adjusting a state of tension of the sheet member.

Applicant believes that another reference corresponds to U.S. Pat. No. 4,248,000 B1 issued to Greenbaum on Feb. 3, 1981 for a receptacle to transport and display an artist's framed canvas. However, it differs from the present invention because Greenbaum teaches an enclosed device for the safe transport of an artist's freshly painted framed canvas immediately after paint has been applied to the surface of the canvas and before the paint has undergone drying by any natural or artificial means, which device protects the canvas from smearing against the interior sides of the device and provides protection from the natural elements, characterized by an enclosed rectangular receptacle with a handle above for carrying and having a transparent front panel fixed by a flexible hinge along the top of the receptacle so that the transparent panel swings downwards and fastens along the bottom of the receptacle and with the interior of the receptacle fitted with a thin, rigid material slanted on an acute angle, secured at the top and bottom of the receptacle's interior so that the slanted material supports an artist's canvas and prevents forward or lateral movement of the canvas by means of a restraining device along the bottom edge of the slanted material and also prevents forward or lateral movement of the canvas with a clamping device along the top edge of the slanting material; in preferred form there being a horizontal framing member along the top of the receptacle to which the carrying handle is attached on the exterior, the clamping device and top edge of the slanted material are attached on the interior, and that the slanted material is molded, bent, formed or shaped at its lower portion to form the restraining device as one continuous piece.

Applicant believes that another reference corresponds to U.S. Pat. No. 4,095,360 B1 issued to Dinan, et al. on Jun. 20, 1978 for a display device. However, it differs from the present invention because Dinan, et al. teaches a display device that comprises a rectangular transparent plastic envelope formed from two sheets of flexible plastic material which are seamed together adjacent their top, one side and bottom margins. The sheets also include horizontal enclosed sleeves at the top and bottom of the envelope in which tubular arms are located. Flexible coupling means are provided in engagement with the upper tubular arm while the lower tubular arm is engaged by laterally spaced tension means which permit the lower arm to turn ninety degrees with respect to the upper arm. A zipper-type closure means may be provided along the open side of the envelope to removably seal the envelope.

Other patents describing the closest subject matter provide for a number of more or less complicated features that fail to solve the problem in an efficient and economical way. None of these patents suggest the novel features of the present invention.

SUMMARY OF THE INVENTION

The present invention is a system for advertising, comprising a post assembly having first and second ends. The first end has a first neck member with a first threaded opening having a cap thereon, and the second end has a second neck member with a second threaded opening. The cap comprises a threaded member extending therefrom that secures into the first threaded opening. The first and second neck members are of a self-lubricated material. The display assembly is rotatably mounted onto the post assembly. The post assembly further comprises at least one stop member extending therefrom to prevent complete rotation of the display assembly.

A display assembly comprises first and second transparent or translucent walls joined at least at first, second, and third edges. The display assembly further comprises a first seam at the first and second transparent or translucent walls to define a first channel, and a second seam to define a second channel. The first and second seams are approximately parallel with respect to each other and are approximately perpendicular with respect to the third and fourth edges. The first seam is adjacent to the first channel, and the second seam is adjacent to the second channel. The display assembly further comprises a fourth edge defining a sealing edge. The sealing edge is a hook and loop type or zipper type fastener.

The display assembly further comprises a first elongated rod having a first circular end and a first lock end. The first elongated rod extends through the first channel. The first circular end is of a cooperative dimension to receive the first neck member. The first circular end extends beyond the third edge and the first lock end extends beyond the fourth edge. A second elongated rod has a second circular end and a second lock end. The second elongated rod extends through the second channel. The second circular end is of a cooperative dimension to receive the second neck member. The second circular end extends beyond the third edge and the second lock end extends beyond the fourth edge. The first and second elongated rods are of a rigid material to prevent the display assembly from bending or flapping. The display assembly displays matter housed between the first and second transparent or translucent walls.

An extension post assembly comprises third and fourth ends, and at least one tension arm. The third end has a first threaded member extending therefrom. The first threaded member secures into the second threaded opening. The fourth end has a third neck member having a third threaded opening. A base assembly has a threaded member, as does an anchor assembly.

It is therefore one of the main objects of the present invention to provide a system for advertising having multiple mounting configurations.

It is another object of this invention to provide a system for advertising having a transparent or translucent cover for holding at least one document and protecting it from rain, wind, and ultraviolet radiation damage.

It is another object of this invention to provide a system for advertising having multiple mounting configurations that can be readily assembled and disassembled without the need of any special tools.

It is another object of this invention to provide a system for advertising that is volumetrically efficient for carrying, transporting, and storage.

It is another object of this invention to provide a system for advertising, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
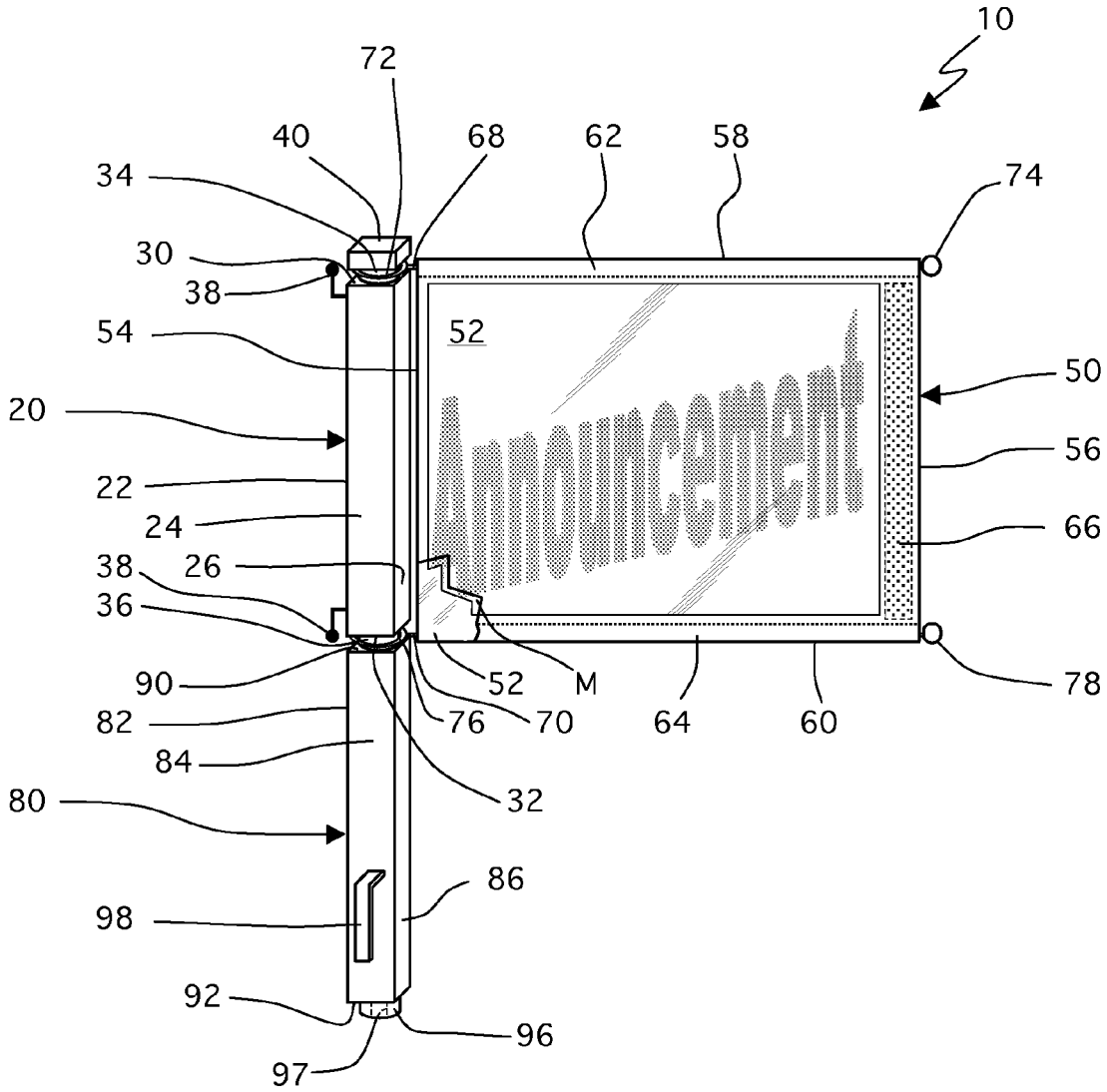
FIG. 1 represents an isometric view of the present invention.

Referring now to the drawings, the present invention is generally referred to with numeral 10. It can be observed that it basically includes post assembly 20, display assembly 50, and extension post assembly 80.

Figure 2:
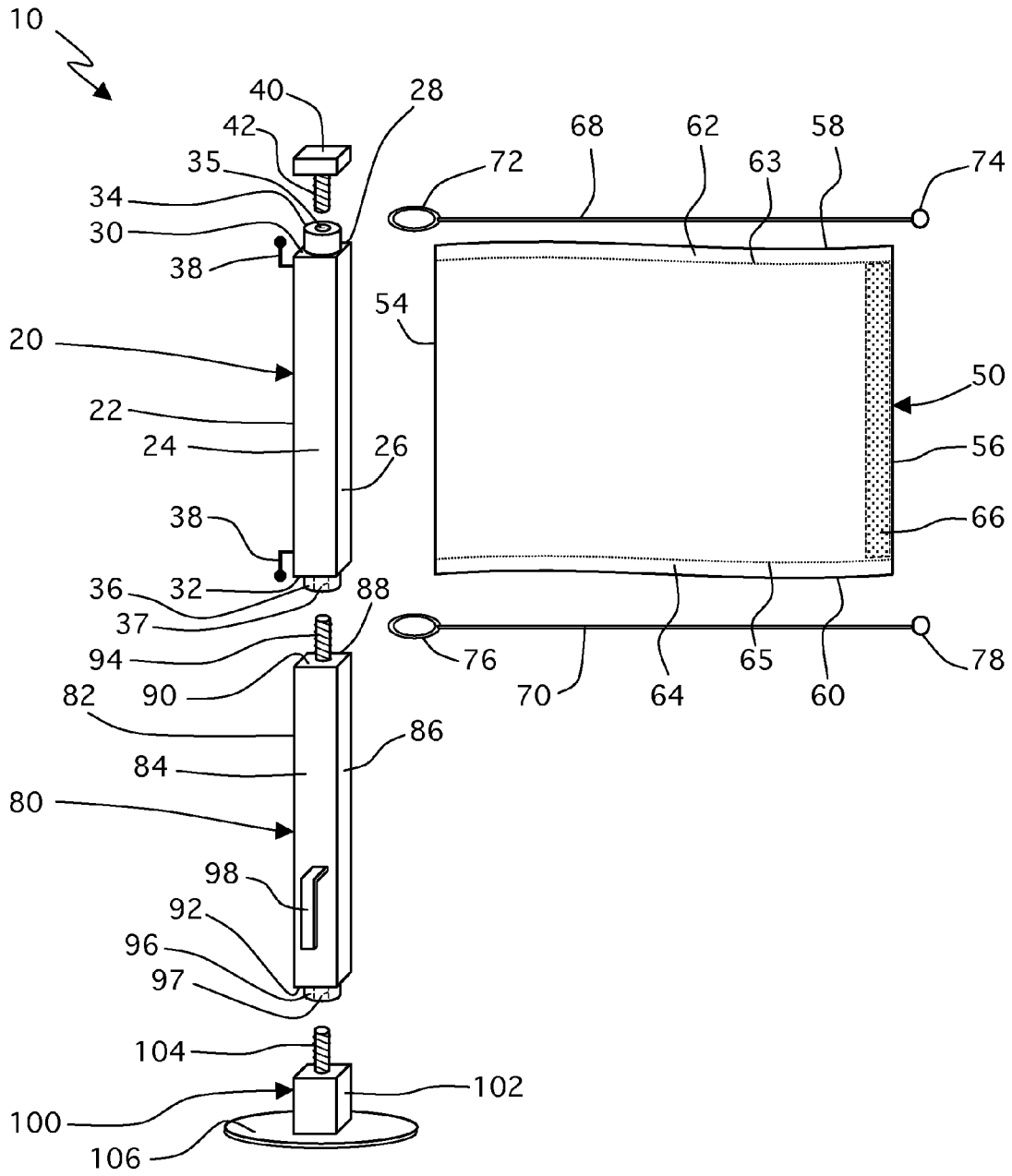
FIG. 2 is a first exploded view of the present invention shown in FIG. 1, and also including a base assembly.
Figure 3:
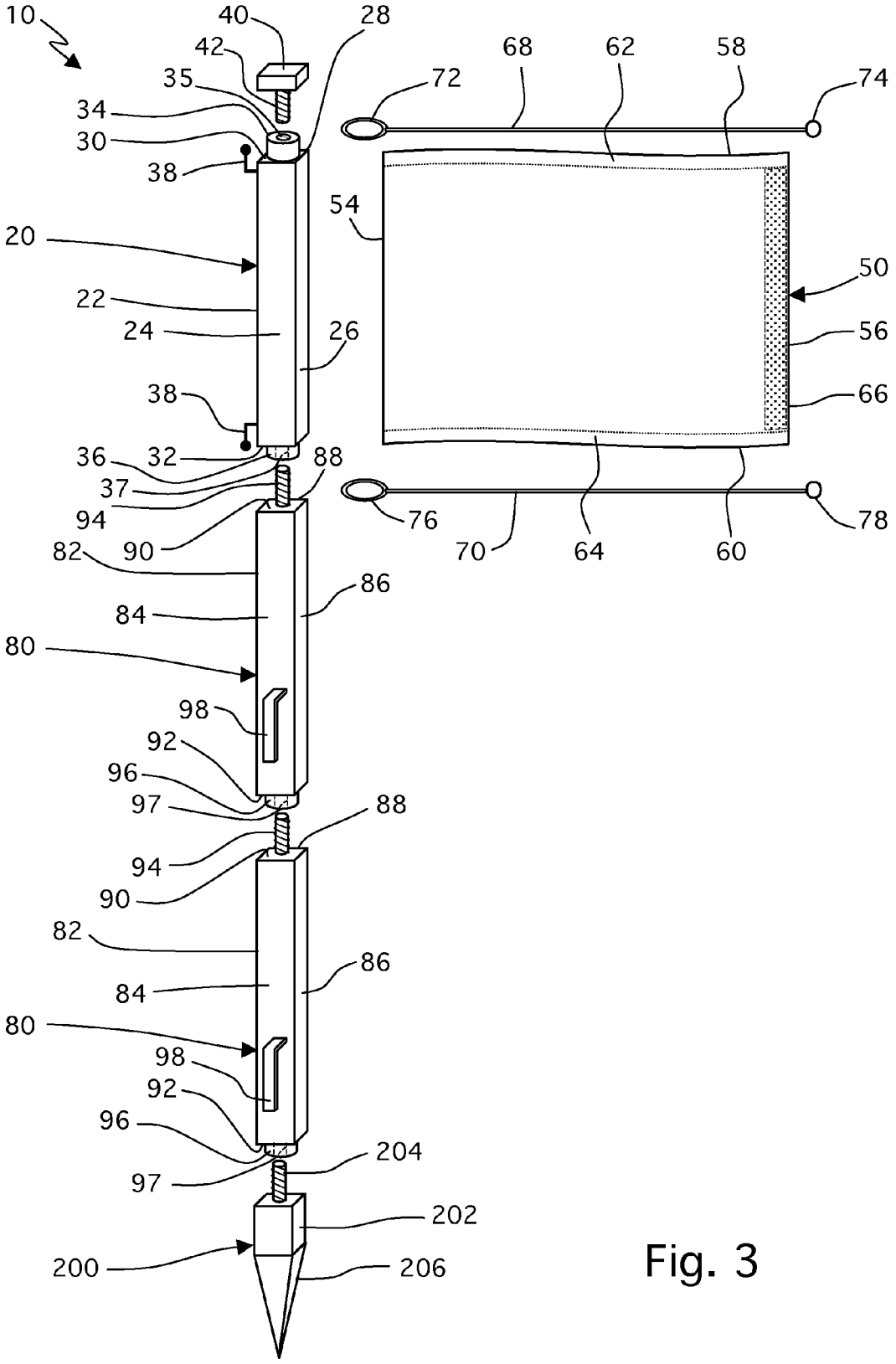
FIG. 3 is a second exploded view of the present invention shown in FIG. 1, and also including a second extension post assembly and an anchor assembly.

As seen in FIGS. 1, 2, and 3 instant invention 10 is a system for advertising, whereby display assembly 50 is rotatably mounted onto post assembly 20.

Post assembly 20 comprises sidewalls 22, 24, 26 and 28, and ends 30 and 32. End 30 has neck member 34 with threaded opening 35 and cap 40 thereon. End 32 has neck member 36 with threaded opening 37. All neck members, and specifically 34, 36, and 96 are of a self-lubricated material, such as polytetrafluoroethylene, to facilitate the smooth rotation of elongated rods 68 and 70. Post assembly 20 further comprises at least one stop member 38 extending therefrom to prevent complete rotation of display assembly 50. Cap 40 comprises threaded member 42 extending therefrom that secures into threaded opening 35, whereby threaded opening 35 receives threaded member 42.

Display assembly 50 comprises first and second transparent or translucent walls 52 joined at least at edges 54, 58, and 60. Display assembly 50 further comprises seam 63 at first and second transparent or translucent walls 52 to define channel 62, and seam 65 to define channel 64. Seams 63 and 65 are approximately parallel with respect to each other and are approximately perpendicular with respect to edges 54 and 56, whereby seam 63 is adjacent to channel 62, and seam 65 is adjacent to channel 64. Edge 56 defines sealing edge 66. In a preferred embodiment, sealing edge 66 is a hook and loop type or zipper type fastener.

Display assembly 50 further comprises elongated rod 68 having circular end 72 and lock end 74, and elongated rod 70 has circular end 76 and lock end 78. Elongated rod 68 extends through channel 62, and elongated rod 70 extends through channel 64. Circular end 72 is of a cooperative dimension to receive all neck members, and specifically 34, 36, and 96; and circular end 72 extends beyond edge 54 and lock end 74 extends beyond edge 56. Circular end 76 is of a cooperative dimension to receive all neck members and specifically neck members 34, 36, and 96; and circular end 76 extends beyond edge 54 and lock end 78 extends beyond edge 56. Elongated rods 68 and 70 are of a rigid material to prevent display assembly 50 from bending or flapping.

Display assembly 50 displays matter M housed between first and second transparent or translucent walls 52, protecting it from rain, wind, and ultraviolet radiation damage. In a preferred embodiment, matter M is advertisement in a print medium or document comprising text, symbols, and/or graphics. The print medium can be made of, but is not limited to, paper, plastic, cardboard, and can be a laminated work. Matter M is inserted into, and removed from, display assembly 50 through sealing edge 66.

Extension post assembly 80 comprises sidewalls 82, 84, 86, and 88, ends 90 and 92, and at least one tension arm 98. End 90 has threaded member 94 extending therefrom that secures into threaded opening 37. Post assembly 20 and extension post assembly 80 are made of a resistant lightweight material. End 92 has neck member 96 with threaded opening 97. Optionally, additional display assemblies 50 may be mounted onto all neck members and specifically neck members 34, 36, and 96.

As seen in FIG. 2, base assembly 100 has post 102, base 106, and threaded member 104. Threaded opening 97 receives threaded member 104.

As seen in FIG. 3, anchor assembly 200 has post 202, base 206, and threaded member 204. It is noted that more than one extension post assemblies 80 can be mounted contiguously. Specifically, threaded member 94 of a lower post assembly 80 can be mounted upon threaded opening 97 of a contiguous upper post assembly 80, and threaded opening 97 receives threaded member 204.

Instant invention 10 therefore is a system for advertisement having multiple mounting configurations.

In a first mounting configuration, instant invention 10 may be mounted onto a vehicle window with tension arm 98 cooperatively engaged thereon. Instant invention 10 may also be mounted onto any surface, preferably in an approximately vertical orientation, permitting tension arm 98 to be cooperatively engaged. Such a surface can be a plate, fence, or mounting frame as an example.

In a second mounting configuration, instant invention 10 may be placed onto any substantially horizontal surface permitting base assembly 100 to rest upon.

In a third mounting configuration, instant invention 10 may be placed or planted into any surface with anchor assembly 200.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for advertising, comprising:

A) a post assembly comprising first and second ends, said first end having a first neck member with a first threaded opening having a cap thereon, and said second end having a second neck member with a second threaded opening;

B) a display assembly comprising first and second transparent or translucent walls joined at least at first, second, and third edges, said display assembly further comprises a first seam at said first and second transparent or translucent walls to define a first channel and a second seam to define a second channel, said display assembly further comprises a fourth edge defining a sealing edge, said display assembly further comprises a first elongated rod having a first circular end and a first lock end, said first elongated rod extends through said first channel, and a second elongated rod having a second circular end and a second lock end, said second elongated rod extends through said second channel, said display assembly displays matter housed between said first and second transparent or translucent walls; and C) at least one extension post assembly comprising third and fourth ends, and at least one tension arm, said third end has a first threaded member extending therefrom, said first threaded member secures into said second threaded opening.

2. The system for advertising set forth in claim 1, further characterized in that said display assembly is rotatably mounted onto said post assembly.

3. The system for advertising set forth in claim 1, further characterized in that said post assembly further comprises at least one stop member extending therefrom to prevent complete rotation of said display assembly.

4. The system for advertising set forth in claim 1, further characterized in that said cap comprises a second threaded member extending therefrom that secures into said first threaded opening.

5. The system for advertising set forth in claim 1, further characterized in that said second threaded opening receives said first threaded member.

6. The system for advertising set forth in claim 1, further characterized in that said first circular end is of a cooperative dimension to receive said first neck member.

7. The system for advertising set forth in claim 1, further characterized in that said first circular end extends beyond said third edge and said first lock end extends beyond said fourth edge.

8. The system for advertising set forth in claim 1, further characterized in that said second circular end is of a cooperative dimension to receive said second neck member.

9. The system for advertising set forth in claim 1, further characterized in that said second circular end extends beyond said third edge and said second lock end extends beyond said fourth edge.

10. The system for advertising set forth in claim 1, further characterized in that said first and second seams are approximately parallel with respect to each other.

11. The system for advertising set forth in claim 1, further characterized in that said first and second seams are approximately perpendicular with respect to said third and fourth edges.

12. The system for advertising set forth in claim 1, further characterized in that said sealing edge is a hook and loop type or zipper type fastener.

13. The system for advertising set forth in claim 1, further characterized in that said fourth end has a third neck member with a third threaded opening.

14. The system for advertising set forth in claim 13, further comprising a base assembly having a second threaded member.

15. The system for advertising set forth in claim 14, further characterized in that said third threaded opening receives said second threaded member.

16. The system for advertising set forth in claim 13, further comprising an anchor assembly having a second threaded member.

17. The system for advertising set forth in claim 16, further characterized in that said third threaded opening receives said second threaded member.

18. The system for advertising set forth in claim 1, further characterized in that said first seam is adjacent to said first channel, and said second seam is adjacent to said second channel.

19. The system for advertising set forth in claim 1, further characterized in that said first and second elongated rods are of a rigid material to prevent said display assembly from bending or flapping.

20. The system for advertising set forth in claim 13, further characterized in that said first, second, and third neck members are of a self-lubricated material.

* * * * *